US008426100B2

(12) United States Patent
Chun et al.

(10) Patent No.: US 8,426,100 B2
(45) Date of Patent: Apr. 23, 2013

(54) LIQUID ELECTROPHOTOGRAPHIC INK CONCENTRATES AND METHODS FOR PREPARING THE SAME

(75) Inventors: Doris Pik-Yiu Chun, Santa Clara, CA (US); Sivapackia Ganapathiappan, Los Altos, CA (US); Hou T. Ng, Campbell, CA (US); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 263 days.

(21) Appl. No.: 13/018,282

(22) Filed: Jan. 31, 2011

(65) Prior Publication Data

US 2012/0196222 A1 Aug. 2, 2012

(51) Int. Cl.
*G03G 9/12* (2006.01)

(52) U.S. Cl.
USPC ..... 430/137.22

(58) Field of Classification Search ..... 430/137.22
See application file for complete search history.

(56) References Cited

U.S. PATENT DOCUMENTS

| | | | | |
|---|---|---|---|---|
| 5,026,427 | A | 6/1991 | Mitchell et al. | |
| 5,345,296 | A | 9/1994 | Wellings | |
| 5,530,533 | A | 6/1996 | Wallace | |
| 5,679,138 | A | 10/1997 | Bishop et al. | |
| 6,136,493 | A * | 10/2000 | Fujiwara et al. | 430/116 |
| 7,402,614 | B2 | 7/2008 | Marguerettaz et al. | |
| 2006/0023041 | A1 | 2/2006 | Brenner et al. | |
| 2008/0262122 | A1 | 10/2008 | Ueno et al. | |
| 2008/0275163 | A1 | 11/2008 | Liu | |

FOREIGN PATENT DOCUMENTS

| | | |
|---|---|---|
| WO | WO 98/44058 | 10/1998 |
| WO | WO 2008/054386 A1 | 5/2008 |

* cited by examiner

*Primary Examiner* — Hoa V Le

(57) ABSTRACT

Liquid electrophotographic ink concentrates and methods of preparing the same are disclosed herein. An example of the method includes preparing a mixture of ink components using a first predetermined thermal profile. The ink components include a resin, a pigment, and a carrier. The method further includes preparing a microfluidizer with a composition at a temperature within a predetermined range and processing the mixture in the prepared microfluidizer to form the concentrate. Processing the mixture includes pressure-feeding the mixture into the prepared microfluidizer, passing the mixture through the prepared microfluidizer for a predetermined number of times, and utilizing a second predetermined thermal profile while passing the mixture through the prepared microfluidizer. A viscosity modifier is added to the mixture before and/or during the processing of the mixture.

12 Claims, 2 Drawing Sheets

LIQUID ELECTROPHOTOGRAPHIC INK CONCENTRATES AND METHODS FOR PREPARING THE SAME

BACKGROUND

The present disclosure relates generally to liquid electrophotographic ink concentrates and methods for preparing the same.

The global print market is in the process of transforming from analog printing to digital printing. Liquid-based inks, including those used in liquid electrophotographic printing, often contain a relatively large amount of carrier fluid. In some cases, the carrier fluid may make up from about 75 vol % to about 90 vol % of the total amount of the ink. The presence of such a large amount of carrier fluid increases the volume of the ink. Increased volume may require that the ink be contained in a relatively large container, which may, in some instances, adversely affect shipping and/or ink storage practices. Additionally, the presence of such a large amount of carrier fluid often equates to relatively high post-printing waste (e.g., because, in many instances, about 95% of the carrier fluid does not reach the media during printing).

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Pigment-based electrophotographic inks that are printable (i.e., print-ready inks) using a liquid electrophotographic printer often contain an ink vehicle having a colorant dispersed therein. Disclosed herein are continuous production methods to derive a liquid electrophotographic ink concentrate with a relatively high non-volatile solids content (e.g., from about 20% to about 70%). The concentrate includes pigment particles with a printable particle size (e.g., from about 500 nm to about 5 μm) and a suitable charge polarity. The concentrate is also readily dispersible in an ink vehicle to form a print-ready ink.

As used herein, the term "ink vehicle" refers to the combination of a carrier/carrier fluid and, in some instances, one or more liquid additives to form the vehicle in which the colorant and other solid components may be dispersed to form the print-ready ink. Further, the term "carrier fluid" refers to the liquid-based medium constituting the bulk of the ink vehicle, and this liquid-based medium is used to transport the colorant through the printer during printing. As used herein, the term "liquid composition" refers to the carrier fluid (with or without other liquid additives) used in the ink concentrate.

Additives that may be desirable in the print-ready inks include other liquid-based components (i.e., those that are in addition to the carrier fluid such as, e.g., one or more other solvents, surfactants, etc.) and/or solid-based components. As previously mentioned, all of the liquid-based components (i.e., the carrier fluid and the other liquid-based additives) together may be referred to herein as the ink vehicle (when discussing the print-ready ink) or the liquid composition (when discussing the ink concentrate). The solid-based components make up a portion of the nonvolatile solids (NVS) of the ink. These solid-based components may include a viscosity modifier and/or a resin. The solid-based components may also include dispersant that is used to encapsulate pigment particles, and, in some instances, additional dispersant that is not used to encapsulate pigment particles. It is to be understood that the rest of the NVS of the ink(s) disclosed herein are made up of the pigment particles.

Figure 1:
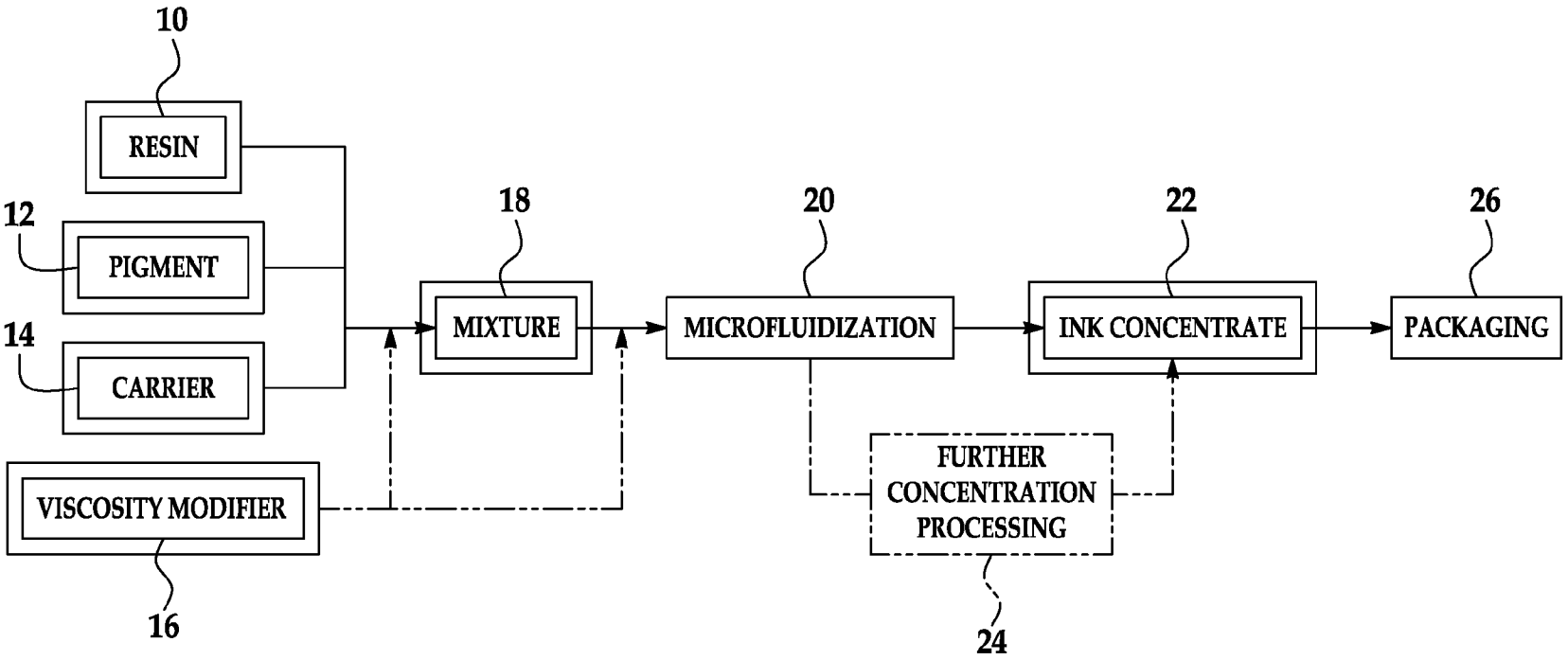
FIG. 1 is a schematic flow diagram illustrating an example of the method for preparing a liquid electrophotographic ink.

Referring now to FIG. 1, an example of the method for preparing the ink concentrate 22 is schematically depicted. FIG. 1 illustrates the general process which begins with preparing a mixture 18 of ink components using a first thermal profile. The ink components include at least a resin 10, a pigment 12, and a carrier 14. It is to be understood that a viscosity modifier 16 is also added, either when forming the mixture 18 or when processing the mixture 18 (e.g., in the microfluidizer).

Any suitable resin 10 may be used. In one example, the resin 10 is a polyethylene based resin. Examples of such resins are commercially available from DuPont (e.g., those in the NUCREL® series, such as NUCREL® 599, 960, 925, etc., and the BYNEL® series) and Honeywell (e.g., those in the A-C series).

A single resin 10 or a mixture of two or more resins 12 may be utilized. The resin(s) is/are added in any suitable amount ranging from 20% to about 1000% with respect to the amount of pigments used.

The pigment 12 may be selected from organic pigment particles or inorganic pigment particles, and these particles may have any particle size that allows the composition including the pigment to be printed from the digital printer. During processing, the pigments 12 become encapsulated by the resin 10. In one example, the final particle size (i.e., the diameter of resin-encapsulated pigment particles) ranges from about 500 nm to about 5 μm. In another example, the average final particle size is about 2 μm. When metallic or pearlescent pigments are utilized, the final particle size may be up to 20 μm. Since the size of the pigments 12 may be reduced during processing, it is to be understood that the starting size of the pigments 12 may be larger than those listed herein.

Organic or inorganic pigment particles may be selected from black pigment particles, yellow pigment particles, magenta pigment particles, red pigment particles, cyan pigment particles, blue pigment particles, green pigment particles, orange pigment particles, brown pigment particles, and white pigment particles. In some instances, the organic or inorganic pigment particles may include spot-color or specialty pigment particles. Spot-color pigments are formed from a combination of a predefined ratio of two or more primary color pigment particles. Specialty pigments may, e.g., be metallic, fluorescent and/or opalescent pigments.

An example of a suitable inorganic black pigment includes carbon black. Examples of carbon black pigments include those manufactured by Mitsubishi Chemical Corporation, Japan (such as, e.g., carbon black No. 2300, No. 900, MCF88, No. 33, No. 40, No. 45, No. 52, MA7, MA8, MA100, and No. 2200B); various carbon black pigments of the RAVEN® series manufactured by Columbian Chemicals Company, Marietta, Ga., (such as, e.g., RAVEN® 5750, RAVEN® 5250, RAVEN® 5000, RAVEN® 3500, RAVEN® 1255, and RAVEN® 700); various carbon black pigments of the REGAL® series, the MOGUL® series, or the MONARCH® series manufactured by Cabot Corporation, Boston, Mass., (such as, e.g., REGAL® 400R, REGAL® 330R, and REGAL® 660R); and various black pigments manufactured by Evonik Degussa Corporation, Parsippany, N.J., (such as, e.g., Color Black FW1, Color Black FW2, Color Black FW2V, Color Black FW18, Color Black FW200, Color Black S150, Color Black S160, Color Black S170, PRINTEX® 35, PRINTEX® U, PRINTEX® V, PRINTEX® 140U, Special Black 5, Special Black 4A, and Special Black 4). An example of an organic black pigment includes aniline black, such as C.I. Pigment Black 1.

Some examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, C.I. Pigment Yellow 167, C.I. Pigment Yellow 172, C.I. Pigment Yellow 180, and C.I. Pigment Yellow 185.

Examples of suitable magenta or red organic pigments include C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245, C.I. Pigment Violet 19, C.I. Pigment Violet 23, C.I. Pigment Violet 32, C.I. Pigment Violet 33, C.I. Pigment Violet 36, C.I. Pigment Violet 38, C.I. Pigment Violet 43, and C.I. Pigment Violet 50.

Examples of blue or cyan organic pigments include C.I. Pigment Blue 1, C.I. Pigment Blue 2, C.I. Pigment Blue 3, C.I. Pigment Blue 15, C.I. Pigment Blue 15:3, C.I. Pigment Blue 15:34, C.I. Pigment Blue 15:4, C.I. Pigment Blue 16, C.I. Pigment Blue 18, C.I. Pigment Blue 22, C.I. Pigment Blue 25, C.I. Pigment Blue 60, C.I. Pigment Blue 65, C.I. Pigment Blue 66, C.I. Vat Blue 4, and C.I. Vat Blue 60.

Suitable examples of green organic pigments include C.I. Pigment Green 1, C.I. Pigment Green 2, C.I. Pigment Green, 4, C.I. Pigment Green 7, C.I. Pigment Green 8, C.I. Pigment Green 10, C.I. Pigment Green 36, and C.I. Pigment Green 45.

Still further, examples of brown organic pigments include C.I. Pigment Brown 1, C.I. Pigment Brown 5, C.I. Pigment Brown 22, C.I. Pigment Brown 23, C.I. Pigment Brown 25, and C.I. Pigment Brown, C.I. Pigment Brown 41, and C.I. Pigment Brown 42.

Examples of orange organic pigments include C.I. Pigment Orange 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43, and C.I. Pigment Orange 66.

In another example, the pigment 12 may be selected from metallic pigments, where the metallic pigments also have a particle size enabling the final print-ready ink to be printed from the electrophotographic printer. In an example, the final particle size of the metallic pigment ranges from about 0.01 μm to about 20 μm. Suitable metallic pigments include, but are not limited to, a metal selected from gold, silver, platinum, nickel, chromium, tin, zinc, indium, titanium, copper, aluminum, and alloys of any of these metals. These metals may be used alone or in combinations with two or more metals or metal alloys. Non-limiting examples of metallic pigments include Standard R0100, Standard R0200, and DORADO PX™ 4001 (available from Eckart Effect Pigments, Wesel, Germany).

In yet another example, the pigment 12 may be selected from a pearlescent pigment (also known as an opalescent pigment), where the pearlescent pigments have a particle size that enable the composition to be printed from the digital printer. In an example, the final pearlescent particle size ranges from about 0.01 μm to about 20 μm. It is to be understood that suitable pearlescent pigments are those that tend to exhibit various colors depending on the angle of illumination and/or of viewing. Non-limiting examples of pearlescent pigments include those of the PRESTIGE® series and of the DORADO PX™ series, both of which are available from Eckart Effect Pigments.

A single pigment 12 or a mixture of two or more pigments 12 may be utilized. The pigment(s) 12 is/are added in any suitable amount ranging from 1% to about 40% of the non-volatile solids (NVS) of the concentrate 22.

The carrier 14 is an oil-based carrier. Examples of suitable carriers 14 include perchloroethylene, halocarbons (such as halocarbon 0.8, halocarbon 1.8, halocarbon 4.2, and halocarbon 6.3), cyclohexane, dodecane, mineral oil, isoparaffinic fluids (such as those in the ISOPAR® series available from Exxon Mobile Corp., Houston, Tex., such as ISOPAR®L, ISOPAR®M, ISOPAR®G, and ISOPAR®V), siloxanes (e.g., cyclopentasiloxane and cyclohexasiloxane), and mixtures thereof. The carrier(s) 14 is/are added in any suitable amount ranging from about 30% to about 80% of the ink concentrate 22. The NVS of the ink concentrate 22 ranges from about 20% to about 70%, and the carrier 14 (or carrier 14 plus other liquid additive(s)) make up the balance of the ink concentrate 22. It is to be understood that the total percentage of the liquid composition in the ink concentrate 22 ranges from about 30% to about 80%, and includes carrier 14 (and possibly other liquid additives) that is added throughout the process. As such, the amount of carrier 14 added during preparation of the mixture 18 may be outside the stated range, depending, at least in part, on the total NVS and the amount of liquid added at other steps in the process. For example, carrier 14 may be added during mixture 18 preparation and during microfluidizer preparation, and thus the amount of carrier 14 used to make the mixture 18 may be altered to account for the amount that is subsequently added during microfluidizer prep so that the final amount is within the desired range.

The viscosity modifier 16 is any component that reduces the viscosity of the mixture (and thus the resulting concentrate 22) during processing. During processing, the viscosity of the mixture ranges from about 10 cps to about 2500 cps. This viscosity may also be desirable for the final concentrate 22. The viscosity modifier 16 may be a shear-thinning agent (i.e., reduces viscosity when shear is applied) and/or a slipping agent (i.e., introduces lubricity during processing). Examples of viscosity modifiers 16 include erucamide and aliphatic acids having 6 to 50 carbon atoms (e.g., lauric acid, stearic acid, oleic acid, linoleic acid, and cis-5-dodecenoic acid). The viscosity modifier 16 is added in any suitable amount ranging from 0.2% to about 20% of the NVS of the concentrate 22.

As mentioned above, the example of the method shown in FIG. 1 includes preparing the mixture 18 of the ink components 10, 12, and 14, and in some instances 16 using a first thermal profile. The example of the method shown in FIG. 1 also includes preparing a microfluidizer with a composition at a temperature within a predetermined range and processing the mixture 18 in the prepared microfluidizer to form the concentrate 22. Processing generally involves pressure-feeding the mixture 18 into the prepared microfluidizer, passing the mixture 18 through the prepared microfluidizer for a predetermined number of times, and utilizing a second thermal profile while passing the mixture 18 through the prepared microfluidizer.

The method shown in FIG. 1 may be performed as a hot process or a cold process. Each of the hot and cold processes involves specific, respective first and second thermal profiles. The use of these thermal profiles is believed to contribute to achieving the concentrate 22 having a desirable viscosity, a desirable non-volatile solids (NVS) content, and resin-encapsulated pigment particles therein. Each of the hot and cold processes will now be described in more detail.

In some examples of the hot process, the selected resin(s) 10 and viscosity modifier(s) 16 are melt-mixed to form a melt mixture. Melt-mixing is accomplished at or above the highest melting point of the resin(s) 10 used. As such, the temperature profile during the preparation of the mixture 18 in the hot process depends upon the resin(s) 10 used. The rate of mixing may vary as is desired, and in one example, the mixing rate ranges from about 150 rpm to about 250 rpm. It may be desirable to perform the mixing to achieve a homogeneous melt mixture (e.g., as observed by the human eye).

While the melt-mixing temperature is maintained, the pigment(s) 12 is/are added to the melt mixture. Stirring/mixing is continued at a similar rate.

In other examples of the hot process, the selected resin(s) 10 are melt-mixed to form a melt mixture in the absence of the viscosity modifier(s) 16. Melt-mixing of the resin(s) 10 is accomplished as previously described, and the pigment(s) 12 are added to the melt mixture. In these examples, the viscosity modifier(s) 16 is/are added to the melt mixture after the pigment(s) 12 are added. One example of the viscosity modifier 16 that is added after the pigment(s) is an aliphatic acid having 6 to 50 carbon atoms.

In still other examples of the hot process, the selected resin(s) 10 are melt-mixed to form a melt mixture in the absence of the viscosity modifier(s) 16. Melt-mixing of the resin(s) 10 is accomplished as previously described, and the pigment(s) 12 are added to the melt mixture. In these particular examples, the viscosity modifier(s) 16 are not part of the melt mixture, but are added subsequently with carrier(s) 14.

In a separate container from any of the previously described melt mixtures, a dispersant is added to the carrier(s) 14 and is dissolved therein. The dispersant is any surfactant that will aid in the dispersion of the selected pigment(s) 12 and resin(s) 10 in the selected carrier(s) 14. In some examples, the dispersant is also a charge director, which is an ionic compound that is soluble in the carrier(s) 14 and will impart a charge on the formed encapsulated pigment particles. Examples of suitable dispersants/charge directors include polyisobutylene succinimide amines, sodium di-2-ethylhexylsulfosuccinate, dioctyl sulfosuccinate, fluorosurfactants, and Lecithin. These dispersants may behave as negative charge directors. Other dispersants behave as positive charge directors, including, for example, cetyltrimethylammonium bromide.

The carrier(s) 14 and dispersant(s) mixture is heated to a temperature ranging from about 90° C. to about 120° C. The heated mixture is then added to the melt mixture (including at least the resin(s) 10 and the pigment(s) 12), and is mixed. It is to be understood that in the examples when the viscosity modifier(s) 16 is/are not included in the melt mixture of resin(s) 10 and pigment(s) 12, the viscosity modifier(s) 16 may be added to the carrier(s) 14 and dispersant(s) mixture prior to heating.

The rate of mixing at this step (i.e., when the two mixtures are combined together) ranges anywhere from about 100 rpm to about 1000 rpm. In one example, mixing at this step takes place for about 30 minutes. It is to be understood that the temperature is maintained at or about the highest melting point of the resin(s) 10 used. This ensures that the melt flow characteristics of the melt mixture are maintained, and that the melt mixture is in flowable form.

In any of the examples of the hot process, the microfluidizer is preloaded with a composition, which includes the same carrier as, or a different carrier from, the carrier(s) 14 used to form the melt mixture. The composition used to prepare the microfluidizer may also include dispersant(s) and/or viscosity modifier(s) 16, and thus may have some solid components. Any of the previously discussed dispersant(s) and/or viscosity modifier(s) 16 may be used. When included in the composition, the dispersant and/or viscosity modifier 16 may each be added in an amount that is up to 10% of the NVS of the ink concentrate 22. In one example, the dispersant and/or viscosity modifier 16 is added to the composition in an amount that is up to 2% of the NVS of the ink concentrate 22. Since the composition becomes part of the final ink concentrate 22, the amount of preloaded composition may be adjusted to achieve the desired NVS in the concentrate 22. As the amount of composition preloaded into the microfluidizer increases, then generally the NVS of the final concentrate decreases. When dispersants and/or viscosity modifiers 16 are included in the preloaded composition, the NVS of the concentrate 22 may not be lowered as much as when such solid components are not included in the preloaded composition (i.e., when the preloaded composition is carrier 14 alone). In one example, the amount of composition preloaded into the microfluidizer (e.g., M110Y) ranges from 5 mL to 20 mL (which is equal to the dead volume inside the equipment which fills the processing loop). The composition is run throughout the process line of the microfluidizer (i.e., from the inlet to the outlet) at least once. The temperature of the composition ranges from about 50° C. to about 130° C. In one example, the temperature of the composition ranges from about 100° C. to about 120° C.

After the composition is run through the microfluidizer at least once, the final melt mixture (including the flowable mixture of resin(s) 10, pigment(s) 12, carrier(s) 14, dispersant(s), and viscosity modifier(s) 16) is pressure-fed into the prepared microfluidizer. The pressure during feeding is maintained anywhere from about 10,000 psi to about 15,000 psi.

The final melt mixture is passed through the microfluidizer anywhere from 2 times to 5 times. The number of times may vary depending upon how long it takes to obtain a homogeneous mixture. The thermal profile used during processing involves maintaining the temperature and then lowering the temperature for the last pass. For example, if two passes are used, the first pass takes place at the higher temperature and then the second pass takes place at the lower temperature. Likewise, if five passes are used, the first four passes take place at the higher temperature and the fifth pass takes place at the lower temperature. For the higher temperature passes, it is to be understood that the temperature of the microfluidizer components (e.g., the heat exchanger, the pressure feeder, etc.) and the microfluidization process temperature range anywhere from about 70° C. to about 120° C. For the lower temperature pass (i.e., the last pass through the microfluidizer), the temperature of the microfluidizer components and the microfluidization process temperature range anywhere from about 20° C. to about 60° C. It is believed that the failure to control the temperature ramp down during final pass through the microfluidizer will result in large flakes that may not be suitable for printing applications.

When a cold process is utilized, the selected resin(s) 10 and viscosity modifier(s) 16 are melt-mixed to form a melt mixture. Melt-mixing is accomplished at or above the highest melting point of the resin(s) 10 used. As such, the temperature profile during the preparation of the mixture 18 in the cold process also depends upon the resin(s) 10 used. The rate of mixing may vary as is desired, and in one example, the mixing rate ranges from about 30 rpm to about 100 rpm. It may be desirable to perform the mixing to achieve a homogeneous melt mixture (e.g., as observed by the human eye).

While the melt-mixing temperature is maintained, the pigment(s) 12 is/are added to the melt mixture. Stirring/mixing is continued at a similar rate.

In a separate container from the melt mixture, a dispersant is added to the carrier(s) 14 and is dissolved therein. Any of the previously described dispersants may be used. The carrier(s) 14 and dispersant mixture is heated to a temperature ranging from about 70° C. and about 90° C., and is added to the melt mixture. The combined mixture is then mixed at the temperature that is at or above the highest melting temperature of the resin(s) 10 used. The rate of mixing at this step (i.e., when the two mixtures are combined together) ranges anywhere from about 100 rpm to about 1000 rpm. In one example, mixing at this step takes place for about 60 minutes.

This mixture is allowed to cool to a temperature where it solidifies. The solidified mixture is ground or otherwise processed to form a powder. In one example, the solidified mixture is sieved through a course screen to form the powder.

In the cold process, the microfluidizer is preloaded with the composition, which includes the same carrier as, or a different carrier from, the carrier(s) 14 used to form the solidified mixture. The composition used to prepare the microfluidizer may also include dispersant(s) and/or viscosity modifier(s) 16. Any of the previously discussed dispersant(s) and/or viscosity modifier(s) 16 may be used in the amounts previously discussed in reference to the hot process. As mentioned with regard to the hot process, the amount of preloaded composition may be adjusted to achieve the desired NVS in the concentrate 22. In one example, the amount of composition preloaded into the microfluidizer (e.g., M110Y) ranges from 5 mL to 20 mL (which is equal to the dead volume inside the equipment which fills the processing loop). The composition is run throughout the process line of the microfluidizer (i.e., from the inlet to the outlet) at least once. The temperature of the composition ranges from about 0° C. to about 60° C. In one example, the temperature of the composition ranges from about 40° C. to about 60° C.

After the composition is run through the microfluidizer at least once, the powder form of the solidified mixture is pressure-fed into the prepared microfluidizer. The pressure during feeding is maintained anywhere from about 10,000 psi to about 15,000 psi. The powder form of the solidified mixture is passed through the microfluidizer anywhere from 1 time to 5 times. In one example, 2 or 3 passes are utilized.

The thermal profile used during processing in the cold process involves maintaining the temperature from about 40° C. to about 60° C.

During either the hot or cold process, it is to be understood that a stabilizer may be added to the melt mixture prior to or during microfluidizer processing. Stabilizers may be added in an amount ranging from about 1% to about 20% of the total amount of pigment(s) 12 and resin(s) 10 that is used. Some examples of stabilizers include polyisobutylene-based dispersants and dioctylsulfosuccinimide dispersants.

Both the hot and cold processes yield the concentrate 22 which includes 20% to 70% of non-volatile solids (including resin encapsulated pigment particles, viscosity modifier, etc.) and a balance of the liquid composition. As mentioned herein, the liquid composition includes those liquid components introduced prior to and/or during microfluidization.

Whether the hot or cold process is used to form the concentrate 22, the method may further include additional concentration processes (see reference numeral 24 in FIG. 1). It is believed that additional concentration processing may further increase the final NVS of the concentrate 22. Examples of additional concentration processes include drying using a flat-bed drying belt or centrifugation. The flat-bed drying belt removes excess liquid content by applying sufficient heat to the concentrate 22 without fusing the resins to evaporate liquid carrier. Centrifugation involves the removal of liquid content by exerting centripetal force onto the concentrate 22, forcing the liquid through a porous containment to reduce liquid content. In one example, centrifugation may be used in instances when the pigment particles 12 have a higher density than the liquid component(s). Centrifugation in this case may suitably separate the more dense pigment particles (and other solids) from the liquid. For instance, the concentrate 22 may be placed in a centrifuge, which spins at a predetermined rate. Centrifugal forces cause the more dense pigment particles 12 to separate away from (e.g., they may settle towards the outer diameter of the centrifuge) the less dense liquid component(s). The speed, time, and/or temperature of the centrifuge may be controlled to control the separation of the pigment particles 12 from the liquid component(s). After centrifugation, decanting may be performed to remove the separated liquid component(s). In an example, most of the liquid component(s) (e.g., at least 80%) may be removed via decanting. Although decanting removes most of the liquid component(s), it is to be understood that some of the liquid component(s) typically remains with the solids.

Once the concentrate 22 is formed, it is packaged into a suitable container (see, e.g., reference numeral 26 in FIG. 1). The container may be a reservoir or cartridge (e.g., cartridge 36 shown in FIG. 2).

The concentrate 22 may be readily dispersed into an ink vehicle to form a print-ready ink. The dispersion of the concentrate 22 may be accomplished via mechanical mixing or any other suitable mixing process. The desired NVS of the print-ready ink ranges from about 0.5% to about 5%. As such, the amount of concentrate 22 and the amount of ink vehicle used are enough to generate the print-ready ink with an NVS within the range of from about 0.5% to about 5%. Since the ink concentrate 22 having from about 20% to about 70% NVS is diluted with the ink vehicle to form the print-ready ink having from about 0.5% to about 5% NVS, the amount of ink concentrate 22 used ranges from 0.01% to about 10%.

Figure 2:
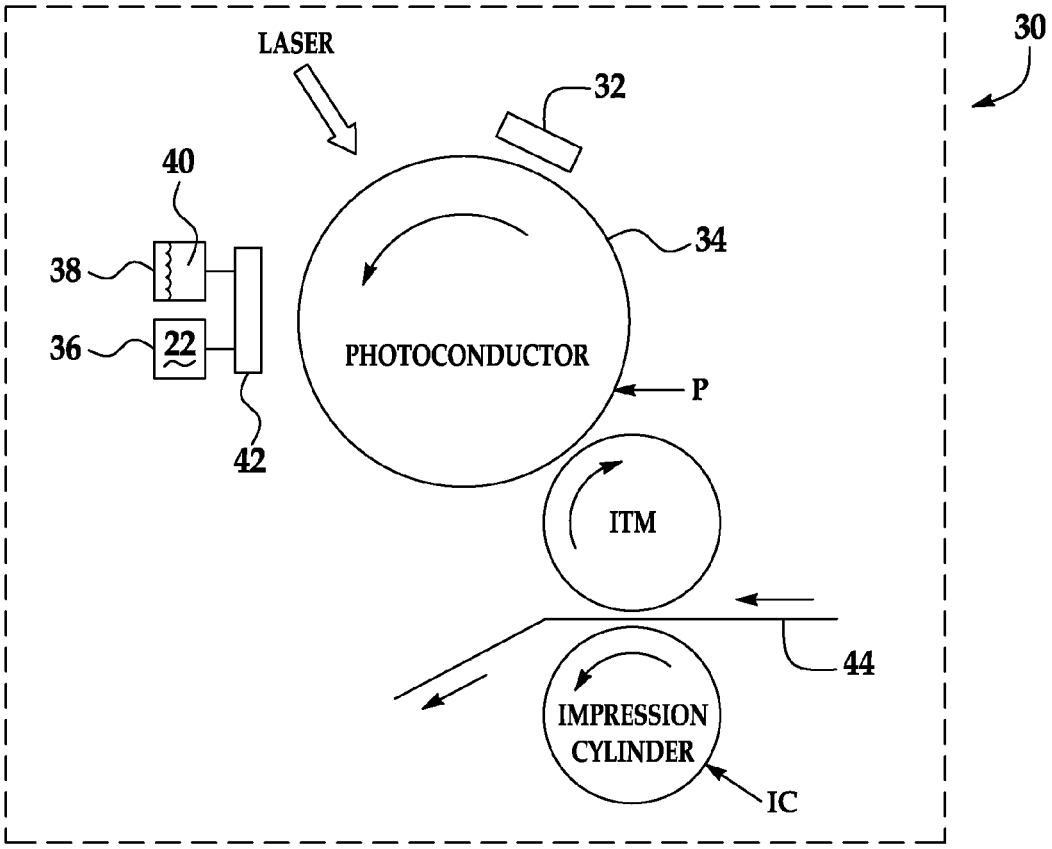
FIG. 2 is a schematic diagram of an example of a printing system.

Referring now to FIG. 2, the ink concentrate 22 may be mixed with an ink vehicle 40 to form a print-ready ink that may be printed from a digital printer or printing system 30 such as, e.g., an electrophotographic printer. In the examples disclosed herein, the electrophotographic printing system 30 includes a corona generator 32. It is to be understood that the corona generator 32 generally has a relatively high electric field, where such electric field is used by the digital printing system 30 for image development. In a non-limiting example, the electric charge or field of the corona discharge ranges from about 1 kV to about 5 kV with a current ranging from about 1 μA to about 1000 μA.

Without being bound to any theory, it is believed that when the corona generator 32 discharges, it forms a high energy species (such as, e.g., radicals, ions, etc.). Depending upon the position of the generator 32 (e.g., when the wire(s) are positioned parallel to the surface to be exposed and are equal to or less than 10 mm apart from the surface to be exposed), the high energy species can create a uniform charge layer on the surface 34 of a photoconductor. The charged species may be produced, for example, during corona discharge of the corona generator 32 that is operatively disposed in the digital printing system 30. The corona generator 32 described herein includes a power supply that is capable of supplying high voltage power to a conductor, such as a discharge electrode. The discharge electrode ionizes the atmosphere or gases surrounding the discharge electrode, thereby forming a reactive species that generates charge on the photoconductor surface 34. As such, the term "corona discharge" refers to an electrical discharge brought on by the ionization of the atmosphere or gases surrounding a conductor, which occurs when the potential gradient (the strength of the electric field) exceeds a certain value, but conditions are insufficient to cause complete electrical breakdown or arcing. The corona generator 32 may include insulation to prevent against electrical shocks, and a ground plate to ground the generator(s).

In the example shown in FIG. 2, the printing system 30 includes a photoconductor P that is configured to rotate in a first direction (as denoted by the left pointing arrow in the photoconductor P). The photoconductor P has a surface 34 that may be exposed to various elements of the system 30 when the photoconductor P is rotated.

The corona generator 32 (such as, e.g., a printer wire or an array of printer wires configured to generate corona discharge) is operatively positioned adjacent to a portion of the surface 34 of the photoconductor P. When the system 30 is in operation, the corona discharge from corona generator 32 generates a charge on the portion of the photoconductor surface 34 exposed to such discharge. It is to be understood that the photoconductor P rotates to develop a uniform layer of charge on the surface 34. As previously described, the charge may be positive or negative, depending upon the type of corona generator 32 used.

The system 30 also includes a laser (labeled "LASER" in FIG. 2) that is positioned adjacent to the photoconductor surface 34. Generally, the laser is positioned such that as the photoconductor P rotates in the first direction, some of the areas of the surface 34 exposed to the corona discharge from the generator 32 are exposed to the emission from the laser. The laser is selected so that its emission can generate charges opposite to those already present on the surface 34 from within the photoconductor 34. By virtue of creating opposite charges, the laser effectively neutralizes some of the previously formed charges at areas exposed to the laser emission. This neutralization forms a latent image. It is to be understood that those areas of the surface 34 not exposed to the laser remain charged.

A processor (not shown) operatively connected to the laser commands the laser to form the latent image so that the remaining charged portions of the surface 34 can be used to generate the desirable digital image. The processor is capable of running suitable software routines or programs for receiving desirable digital images, and generating commands for the generator 32, the cartridges 36, 38, 40, and the various components P, ITM, IC, etc. to reproduce the digital images using the system 30.

The system 30 further includes at least one ink concentrate reservoir/cartridge 36 containing an example of the ink concentrate 22 disclosed herein, at least one ink vehicle reservoir/cartridge 38 containing an ink vehicle 40, and a mixing reservoir/cartridge 42 that receives the ink concentrate 22 and ink vehicle 40.

The mixing reservoir/cartridge 42 includes a disperser (not shown) for dispersing the concentrated ink 22 in the ink vehicle 40 to form the print-ready ink. The disperser may be chosen from any suitable equipment to accomplish the dispersing technique selected. For instance, if dispersing is accomplished via mechanical mixing, the disperser may take the form of a high shear mixer. In another instance, if dispersing is accomplished via ultrasonic mixing, the disperser may take the form of an agitator. Other dispersers may include equipment for high pressure mixing, high shear mixing, high speed mixing, equipment for mechanical pumping, and/or the like.

The ink concentrate reservoir/cartridge 36 and the ink vehicle reservoir/cartridge 38 include ejectors or printheads and are operatively positioned to deposit suitable quantities of the respective components into the mixing reservoir/cartridge 42. The mixing reservoir/cartridge 42 is equipped with ejectors or printheads and are also operatively positioned to deposit the print-ready ink onto the remaining charged portion(s) of the surface 34 to form an ink layer on the surface of the photoconductor 34. In one example, the print-ready ink is selected to carry a charge that is opposite to that of the uniform layer of charge on the surface 34. For example, when a negative charge director is used in the processes described herein, the final print-ready ink is negatively charged over a wide electric field range (e.g., from about 0.2 KV to about 1.5 KV). It is to be understood that the charges remaining on the surface 34 after exposure to the laser will attract the oppositely charged print-ready ink(s) and form an image.

Additionally or alternatively, it is to be understood that electrically neutral carrier(s) (i.e., inks without colorants) can be deposited on the discharged (i.e., neutralized) regions or the remaining charged regions of the surface 34, so that a continuous image is transferred to the substrate 10. Likewise, charged ink can be transferred from cartridge 42 onto the discharged (i.e., neutralized) regions on the surface 34 by applying an appropriate potential bias between the cartridge 42 and the surface 34.

As illustrated in FIG. 2, the system 30 further includes an intermediate transfer medium ITM (which rotates in a second direction that is opposite to direction of rotation of the photoconductor P). It is to be understood that the ITM is grounded or positively biased with respect to the photoconductor P. As the photoconductor P continues to rotate, the image is transferred to the intermediate transfer medium ITM. As illustrated in FIG. 2, the system 30 further includes an impression cylinder IC that is rotatable in the first direction. The impression cylinder IC guides the substrate 44 such that a surface of the substrate 44 contacts the image on the rotating intermediate transfer medium ITM. When in contact, the image transfers to the substrate 10.

While not shown, it is to be understood that the system 30 also includes a charge neutralization unit positioned after the ITM and adjacent to the surface 34 of the photoconductor P. The charge neutralization unit neutralizes any opposite charges remaining on the surface 34 of the photoconductor P prior to the next cycle of printing.

To further illustrate the present disclosure, examples are given herein. It is to be understood that these examples are provided for illustrative purposes and are not to be construed as limiting the scope of the disclosure.

EXAMPLES

Example 1

Hot Process

A mixture of 12.8 g of a polyethylene resin from Dupont and 3.2 g of a polyethylene resin from Honeywell was heated to 150° C. 4 g of yellow pigment (PY 174) was added to the mixture. Mechanical mixing was performed for about 30 minutes, and a homogeneous mixture was obtained. 0.4 g of lauric acid was added to the mixture, which was then stirred.

4 g of a commercial dispersant (OS#199431 available from Lubrizol, 50% NVS) in 25 g of ISOPAR L was added to the mixture slowly at 150° C. This newly formed mixture was then mechanically mixed for about 15 minutes to obtain homogeneity.

This homogeneous mixture was then added to a microfluidizer already having 32 g of ISOPAR L at 70° C. The microfluidization pressure was maintained at about 10,000 psi for about 10 minutes in a closed loop configuration. The homogeneous mixture was passed through the microfluidizer 2 to 3 times. The process temperature was maintained at about 100° C. in the inlet reservoir. During the last pass, the heat exchanger was cooled with water to bring the temperature of the ink paste (i.e., concentrate) to about 50° C. This cooling process solidified the paste and aided in controlling the final particle size. The NVS of the concentrate was 22.6%. The NVS was measured via the removal of volatiles by heating the concentrate to 120° C. for 1 hour.

Example 2

Hot Process

A mixture of 116.7 g of a polyethylene resin from Dupont and 29.2 g of a polyethylene resin from Honeywell was heated to 110° C. 29.2 g of yellow pigment (PY 174) was added to the mixture. Mechanical mixing was performed for about 30 minutes, and a homogeneous pigment-resin mixture was obtained.

In a separate container, 3.75 g Aerosol OT and 3.75 g erucamide were dissolved in 262.5 g ISOPAR L. This mixture was heated to 70° C., and then was added to the pigment-resin mixture. The new mixture was heated to and then maintained between about 110° C. to about 115° C. with continuous stirring at 30 rpm until a homogenous hot melt was obtained. In this example, the continuous stirring is performed for about 40 minutes. The NVS of the hot melt was about 40%.

The hot melt was then added to a microfluidizer already having ISOPAR L at 100° C. The microfluidization pressure was maintained at about 10,000 psi for about 5 minutes, and then the circulating content was collected and additional hot melt was introduced to the microfluidizer. This process was repeated twice until the final mixture reached 38% NVS. The NVS was measured via thermogravimetric analysis.

Example 3

Cold Process 29.2 g of a polyethylene-acrylic acid copolymer from Honeywell, 116.7 g of a polyethylene-methacrylic acid copolymer from Dupont and 1 g erucamide were mixed at 120° C. and at 40 rpm. 29.2 g of pigment blue 15:3 cyan pigment were added to the mixture to form a pigment-resin mixture. Mixing was continued at 40 rpm.

In a separate container, 8.75 g Aerosol OT was dissolved in 262.5 g ISOPAR L. This mixture was heated to 70° C. and then added to the pigment-resin mixture. The NVS of the newly formed mixture was about 40%.

The 40% NVS mixture was maintained and stirred at low rpm (from about 200 rpm to about 300 rpm) at 120° C. for 1 hour, and then was cooled to solidify the mixture. The solidified mixture was broken and sieved through a 450 micron screen to form a loose powder.

1.6 g OLOA 11000 and 0.5 g erucamide were mixed in 100 mL ISOPAR L at 60° C. This mixture was allowed to pass through the microfluidizer at 15000 psi. The system was equilibrated such that both the solution temperature and the heat exchanger were around 50° C.

The sieved powder was gradually introduced into the microfluidizer, and the process pressure was adjusted to about 10,000 psi. The powder was processed until the final NVS was about 30%. The NVS was measured via thermogravimetric analysis.

Example 4

Ink Layer Formation

An ink concentrate was formed having an NVS of 24.5%. The ink concentrate was formed using the resins described in example 3, cyan pigment, ISOPAR L, Aerosol OT, OLOA 11000 and erucamide. A cold process similar to that described in Example 3 was used. The ink concentrate was diluted down to 0.2% NVS or 0.25% NVS by the addition of ISOPAR L.

0.1% or 0.25% of a charge director (CD) was also added to the inks.

A comparative ink concentrate was also tested. Cyan Electroink 4.5 ink concentrate was used as comparative ink concentrate. The comparative ink concentrate was also diluted to about 0.2% NVS using ISOPAR L. A charge director was not added to the comparative ink.

Figure 3:
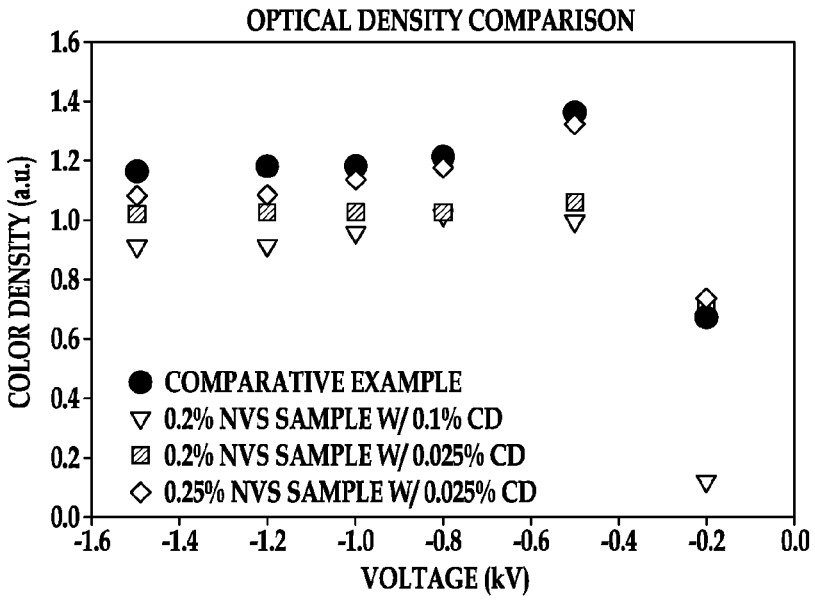
FIG. 3 is a graph illustrating the optical density for examples of ink layers formed using inks prepared with examples of the concentrate disclosed herein and a comparative ink layer.

2 mL of the 0.2% NVS solution, the 0.25% NVS solution, and the comparative solution were respectively introduced into the cavity of a cell composed of two circular electrodes having a diameter of 36 mm and a 1 mm gap. The inks were covered with a piece of coated paper and topped with the opposite electrode. A range of negative voltages was applied to deposit the ink particle inside the cavity onto the coated paper electrochemically. The paper was then removed, allowed to dry and subsequently heat fused at 100° C. for 3 minutes to form an ink layer. The optical densities of the resulting ink layers that were developed at various voltages were then measured by a densitometer and plotted against their development voltage. The optical densities are shown in FIG. 3. The results suggest that the inks formed using the concentrates disclosed herein are comparable with traditional liquid electrophotographic inks.

While several examples have been described in detail, it will be apparent to those skilled in the art that the disclosed examples may be modified. Therefore, the foregoing description is to be considered non-limiting.

What is claimed is:

1. A method for preparing a liquid electrophotographic ink concentrate, comprising:

preparing a mixture of ink components using a first predetermined thermal profile, the ink components including a resin, a pigment, and a carrier;

preparing a microfluidizer with a composition at a temperature within a predetermined range;

processing the mixture in the prepared microfluidizer to form the concentrate by:

pressure-feeding the mixture into the prepared microfluidizer;

passing the mixture through the prepared microfluidizer for a predetermined number of times; and utilizing a second predetermined thermal profile while passing the mixture through the prepared microfluidizer; and adding a viscosity modifier to the mixture any of before or during the processing of the mixture.

2. The method as defined in claim 1, further comprising adding a stabilizer to the mixture any of before or during the processing of the mixture.

3. The method as defined in claim 1, further comprising performing a concentration process after processing the mixture in the prepared microfluidizer.

4. The method as defined in claim 1, further comprising packaging the concentrate in a container.

5. The method as defined in claim 1 wherein preparing the mixture of ink components using the first predetermined thermal profile includes:

melt-mixing the resin and the viscosity modifier at a temperature at or above a melting point of the resin, thereby forming a melt mixture;

adding the pigment to the melt mixture while maintaining the temperature at or above the melting point of the resin;

adding the carrier, having a dispersant dispersed therein, to the melt mixture;

mixing the melt mixture at the temperature at or above the melting point of the resin for a predetermined time; and cooling to solidify the melt mixture and to form the mixture of ink components in a powder form.

6. The method as defined in claim 5 wherein the composition includes a second carrier, a charge director, and a second viscosity modifier, wherein the predetermined range is from about 0° C. to about 60° C., and wherein preparing the microfluidizer includes running the composition through a process line of the microfluidizer.

7. The method as defined in claim 6 wherein:

the pressure-feeding of the mixture includes pressure-feeding the powder form of the mixture into the prepared microfluidizer at a process pressure ranging from 10,000 psi to 15,000 psi;

the predetermined number of times ranges from 1 time to 5 times; and utilizing the second predetermined thermal profile includes maintaining a microfluidization process temperature from about 40° C. to about 60° C.

8. The method as defined in claim 1 wherein preparing the mixture of ink components using the first predetermined thermal profile includes:

melt-mixing the resin at a temperature at or above a melting point of the resin, thereby forming a melt mixture;

adding the pigment to the melt mixture while maintaining the temperature at or above the melting point of the resin;

adding the carrier, having a dispersant dissolved therein, to the melt mixture; and mixing the melt mixture at the temperature at or above the melting point of the resin for a predetermined time to form the mixture in a flowable form.

9. The method as defined in claim 8 wherein after adding the pigment and prior to adding the carrier, the further comprises adding, to the melt mixture, an aliphatic acid having 6 to 50 carbon atoms.

10. The method as defined in claim 8 wherein the composition includes a second carrier, wherein the predetermined range is from about 50° C. to about 130° C., and wherein preparing the microfluidizer includes running the composition through a process line of the microfluidizer.

11. The method as defined in claim 10 wherein the composition further includes any of a second dispersant and a second viscosity modifier.

12. The method as defined in claim 10 wherein:

the pressure-feeding of the mixture includes pressure-feeding the flowable form of the mixture into the prepared microfluidizer at a process pressure ranging from 10,000 psi to 15,000 psi;

the predetermined number of times ranges from 2 times to 5 times; and utilizing the second predetermined thermal profile includes:

maintaining a microfluidization process temperature from about 70° C. to about 120° C. while the flowable form of the mixture is passing through the microfluidizer for each of the predetermined number of times except for a last of the predetermined number of times; and while the flowable form of the mixture is passing through the microfluidizer for the last of the predetermined number of times, cooling the microfluidization process temperature to from about 20° C. to about 60° C.

* * * * *